United States Patent [19]

Chang et al.

[11] Patent Number: 5,016,134

[45] Date of Patent: May 14, 1991

[54] DRIVER CIRCUIT FOR SINGLE COIL MAGNETIC LATCHING RELAY

[75] Inventors: Paul S. Chang, Harrisburg; Lee W. Steely, Mohnton, both of Pa.

[73] Assignee: AMP Incorporated, Harrisburg, Pa.

[21] Appl. No.: 564,227

[22] Filed: Aug. 8, 1990

[51] Int. Cl.[5] ..... H01H 47/32; H01H 47/24

[52] U.S. Cl. ..... 361/153; 361/175; 307/101

[58] Field of Search ..... 361/152, 139, 140, 160, 361/153–156, 166, 168.1, 169.1, 161, 172, 186, 170, 171, 173, 175; 307/101, 104, 125–127, 130, 131, 132 E, 137, 138

[56] References Cited

U.S. PATENT DOCUMENTS

| | | | |
|---|---|---|---|
| 4,001,867 | 1/1977 | Kravitz et al. | 357/39 |
| 4,449,161 | 5/1984 | Kling | 361/152 |
| 4,490,771 | 12/1984 | Huber et al. | 361/154 |

*Primary Examiner*—A. D. Pellinen
*Assistant Examiner*—Richard T. Elms

[57] ABSTRACT

A single coil magnetic latching relay drive circuit which utilizes AC power for energizing/deenergizing the relay. To energize the relay, a single full half cycle of the AC power at a first polarity is applied to the relay coil. To deenergize the relay, a portion of a half cycle of the AC power of the other polarity is applied to the relay coil, this portion being chosen so that the effective current at the other polarity is insufficient to reenergize the relay.

10 Claims, 5 Drawing Sheets

DRIVER CIRCUIT FOR SINGLE COIL MAGNETIC LATCHING RELAY

BACKGROUND OF THE INVENTION

This invention relates to single coil magnetic latching relays and, more particularly, to an arrangement for driving such a relay from an AC source.

When electronic circuitry is utilized to control the application of AC power to a load, a single coil magnetic latching relay is often utilized. The use of a relay provides isolation of the AC power from the electronic circuitry and also takes advantage of the higher current carrying capability of the relay contacts. An advantage of a single coil magnetic latching relay is that only a momentary pulse is needed to cause the relay to change state. Such a relay utilizes the remanent magnetic field of the armature to keep the relay in its driven state. Thus, a continuation of power to the relay coil is not required. However, some magnetic latching relays require a reversal of the polarity of current applied to the coil as well as a current reduction in order to release the relay from its energized state. This is because, if only a current polarity reversal were to be effected, the relay would again energize with an opposite polarity of the magnetic field in the relay armature. Utilizing DC power, the circuitry required to reverse polarity and at the same time reduce the current can be complex and expensive.

It is therefore a primary object of this invention to provide drive circuitry for controlling a single coil magnetic latching relay.

It is another object of this invention to provide such circuitry which is relatively simple in construction.

Since AC power is available, it is a further object of this invention to drive the relay from the AC source.

SUMMARY OF THE INVENTION

The foregoing and additional objects are attained in accordance with the principles of this invention by providing a single coil magnetic latching relay drive circuit which utilizes AC power for energizing/deenergizing the relay. In order to energize the relay, a single full half cycle pulse of the AC power at a first polarity is applied to the relay coil. To deenergize the relay, a pulse which is a portion of a half cycle of the AC power of the other polarity is applied to the relay coil. The portion of the AC cycle used to deenergize the relay is chosen so that the effective current when the relay is deenergized is insufficient to reenergize the relay with the opposite magnetic polarity.

In accordance with an aspect of this invention, feedback is provided for ascertaining the state of the relay and the deenergizing pulses are applied until the feedback indicates that the relay is deenergized.

BRIEF DESCRIPTION OF THE DRAWINGS

The foregoing will be more readily apparent upon reading the following description in conjunction with the drawings in which like elements in different figures thereof have the same reference numeral and wherein.

DETAILED DESCRIPTION

Figure 1:
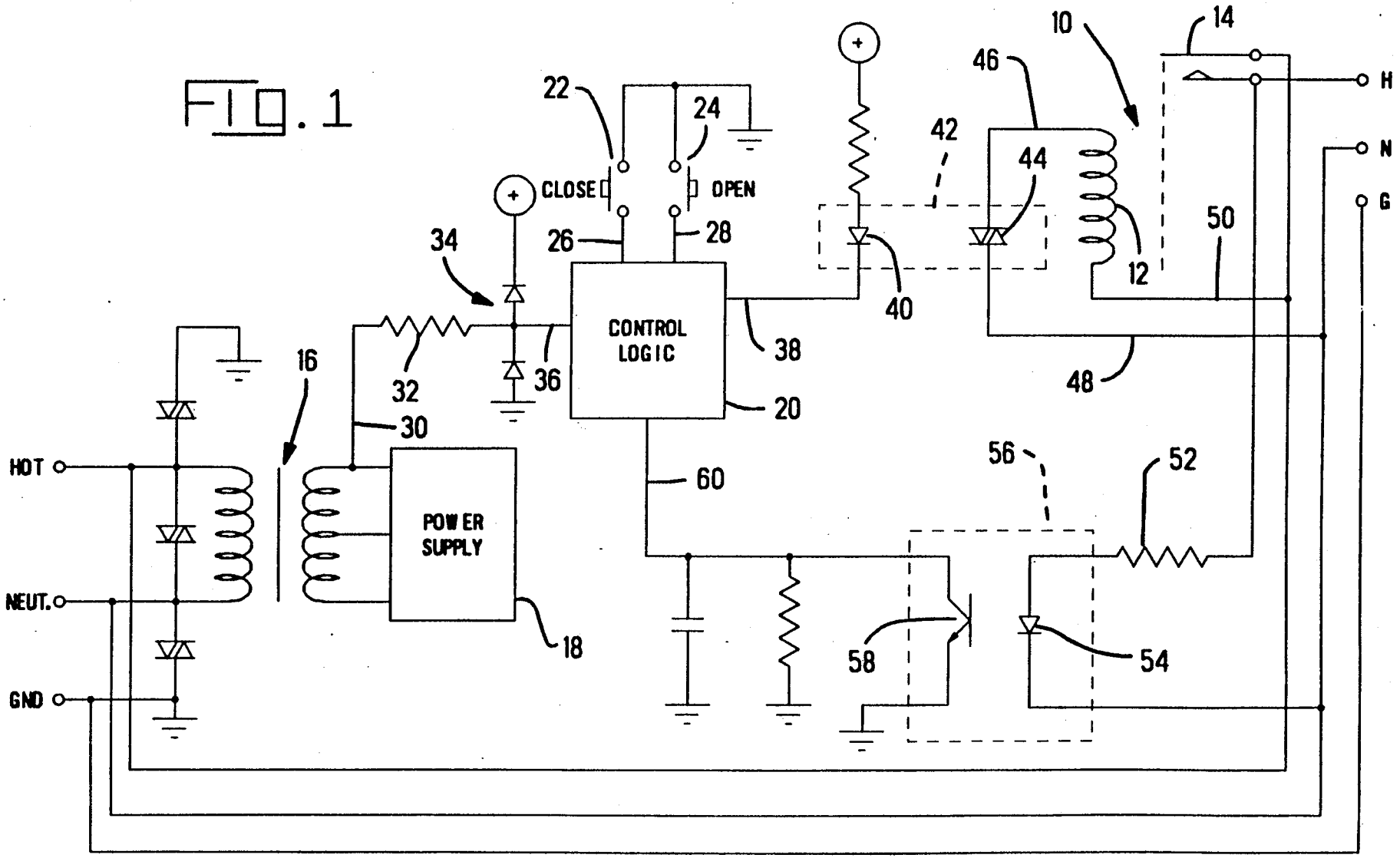
FIG. 1 is a block schematic diagram of a system including circuitry operating in accordance with the principles of this invention for controlling the state of a single coil magnetic latching relay.

FIG. 1 illustrates a system coupled to receive AC power on HOT, NEUTRAL and GROUND lines and to selectively control a single coil magnetic latching relay 10 having a coil 12 and an output switch 14 to supply AC power at the terminals H, N, and G. The system includes a transformer 16 which has its primary winding coupled to the AC source and its secondary winding coupled to the power supply 18, which converts the incoming AC power to DC power for use by the system.

Control of the relay 10 is effected by the control logic 20. The control logic 20 is connected to a close input switch 22 and an open input switch 24. The close input switch 22 is illustrated as a momentary contact switch which applies a ground level signal to the lead 26 when it is desired to close the output switch 14. Likewise, the open input switch 24 is illustrated as a momentary contact switch which applies a ground signal to the lead 28 when it is desired to open the output switch 14. Although momentary contact switches are shown for purposes of illustration, it is understood that the system shown in FIG. 1 may respond to any other appropriate control signals, such as those which may be generated by a computer or the like.

The secondary winding of the transformer 16 is connected via the lead 30 to one end of the resistor 32. The other end of the resistor 32 is connected to the diode network 34 which generates on the lead 36 a train of bilevel pulses which change level at times corresponding to the zero crossings of the incoming AC power. Thus, the pulses on the lead 36 are utilized as clock pulses by the control logic 20.

According to this invention, the control logic 20 operates in response to receiving a signal from the close input switch 22 by applying a half cycle pulse of the AC power having a first polarity through the relay coil 12 so as to energize the relay 10 and cause the output switch 14 to be closed. The characteristics of the relay 10 are such that the remanent magnetic field in the relay armature is sufficient, even after the termination of the energizing pulse, to maintain the relay 10 energized so that the output switch 14 stays in its closed state. In order to deenergize the relay 10 so as to open the output switch 14, a pulse of the opposite polarity must be applied to the coil 12. However, while this pulse must be strong enough to overcome the remanent magnetization of the relay armature, it must not be so strong that it causes the relay 10 to become reenergized with the opposite magnetic polarity. Therefore, the control logic 20 is so arranged, as will be described in full detail hereinafter, that when it receives a signal from the open input switch 24 it applies to the coil 12 a pulse of AC power of the opposite polarity which is only a portion of the half cycle of the AC, that portion being chosen so that the effective current through the coil 12 is insufficient to reenergize the relay 10 with the opposite magnetic polarity.

Thus, control pulses are applied by the control logic 20 to the lead 38. In order to isolate the control logic 20 from the AC applied to the coil 12, which is subject to switching transients and other disturbances, the control pulses on the lead 38 are applied to a light emitting diode 40 which is part of a package 42 including a photosensitive triac 44. The triac 44 is connected via the lead 46 to one end of the relay coil 12 and via the lead 48 to the NEUTRAL line of the AC source. Since the other end of the relay coil 12 is connected via the lead 50 to the HOT lead of the AC source, the triac 44 is in series with the coil 12 so as to act as a switch for selectively closing a conductive path for the AC power through the coil 12.

In one embodiment of the present invention, as will be described in full detail hereinafter, the control logic 20 is required to sense the state of the output switch 14 of the relay 10. Accordingly, a feedback network is provided. This feedback network includes a resistor 52 having a first end connected to the output hot (H) lead and a second end connected to the anode of the light emitting diode 54, whose cathode is connected to the neutral (N) AC line. The light emitting diode 54 is part of a package 56 which also includes a photosensitive transistor 58. Thus, whenever the output switch 14 of the relay 10 is closed, current flows through the diode 54 during positive half cycles of the AC power, causing the transistor 58 to become conductive, and applying a low signal on the lead 60 to the control logic 20. The R-C network at the output of the transistor 58 keeps this signal low during the negative half cycles when the output switch 14 is closed.

Figure 2:
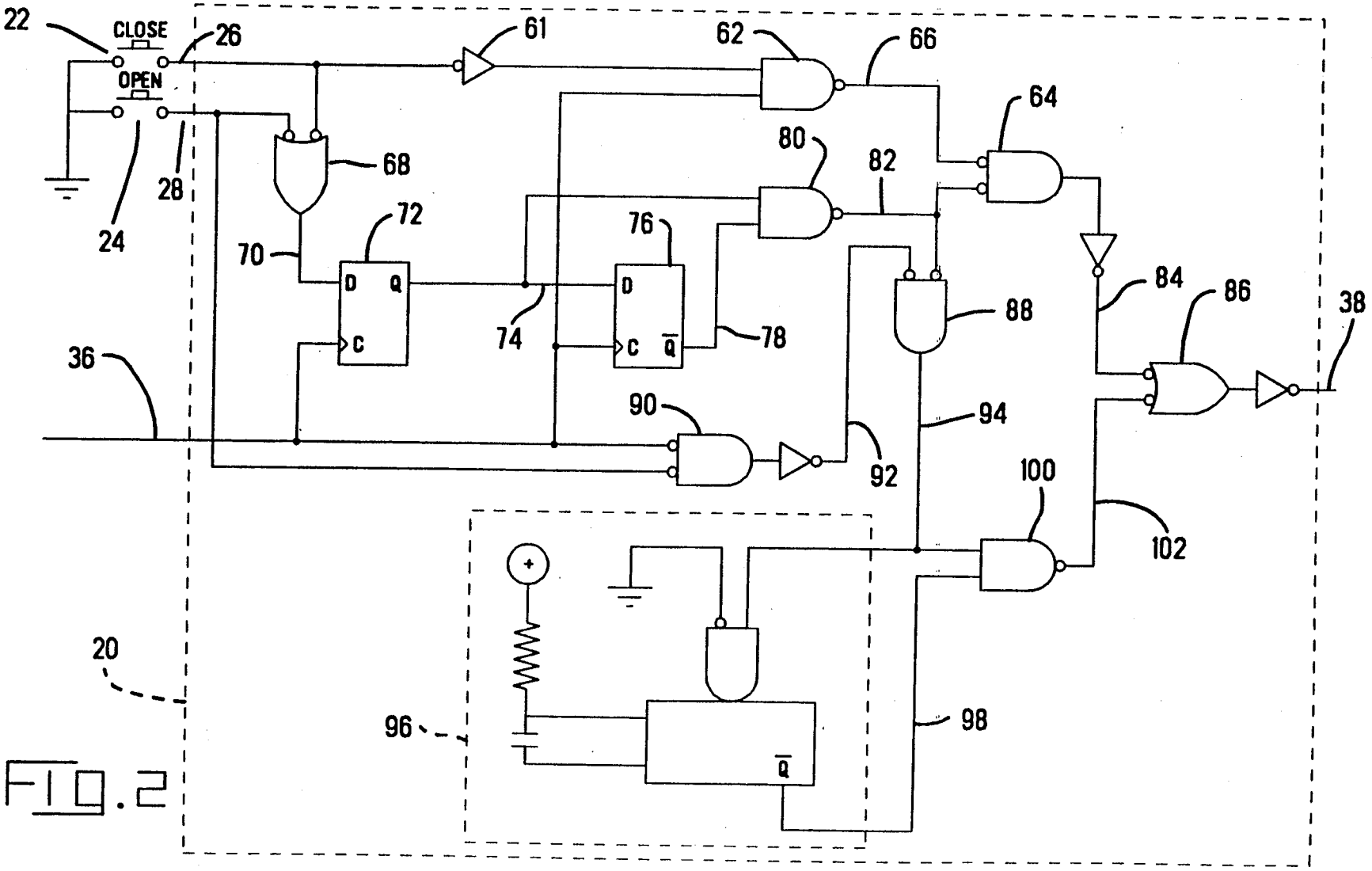
FIG. 2 is a schematic logic diagram of a first embodiment of control logic circuitry according to this invention for use in the system of FIG. 1.
Figure 3:
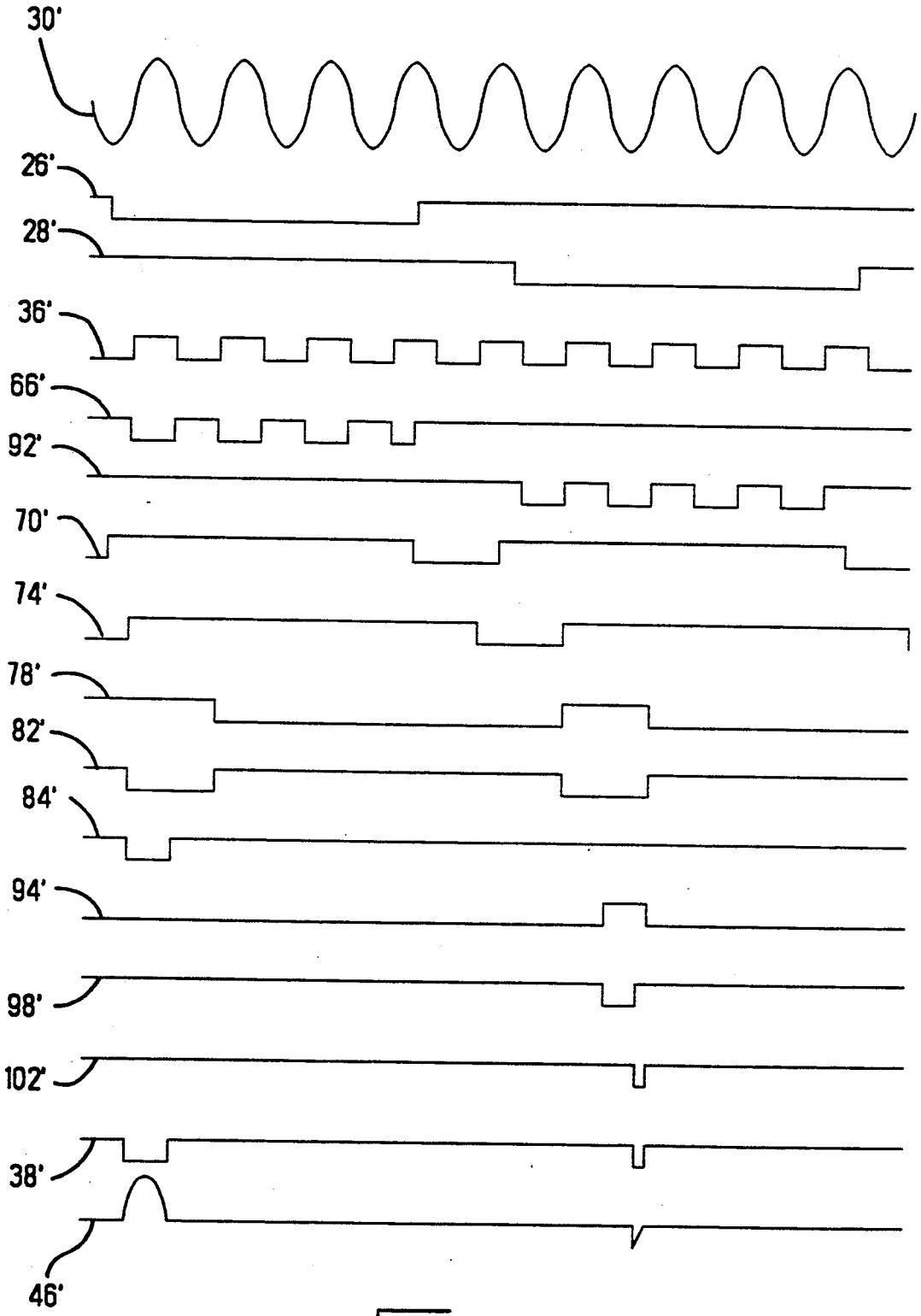
FIG. 3 is a timing chart useful in understanding the operation of the circuitry shown in FIG. 2.

FIG. 2 illustrates a first embodiment for the control logic 20 wherein a single "close" pulse is generated and a single "open" pulse is generated. An understanding of the operation of the circuit shown in FIG. 2 is best accomplished by referring to the timing chart shown in FIG. 3 which illustrates signals on different leads of the circuit shown in FIG. 2, and wherein the reference numerals applied to the signals shown in FIG. 3 correspond to the reference numerals of the corresponding leads in FIG. 2, but are primed.

Referring now to FIG. 2, it is initially assumed that the relay 10 is not energized and the output switch 14 is open. When it is desired to close the output switch 14, the close input switch 22 is momentarily closed, putting a low signal on the lead 26. This low signal is inverted by the inverter 61 and applied as an input to the NAND gate 62. The other input to the NAND gate 62 is the series of bilevel clock pulses on the lead 36 which correspond to the cycles of the input AC power. The output of the NAND gate 62 is applied as an input to the AND-NOT gate 64 via the lead 66. The close input signal on the lead 26 is also applied to the OR-NOT gate 68, whose output on the lead 70 is applied to the D input of the D-type flip-flop 72. The bilevel clock signal on the lead 36 is applied to the clock input of the D-type flip-flop 72. As is known in the art, when a clock pulse appears at the clock input of a D-type flip-flop, whatever signal is present at the D input of the flip-flop results in that signal being transferred to the Q output of the flip-flop. Thus, at the next positive-going transition of the clock signal on the lead 36, the close signal on the lead 26, which is inverted by the gate 68, appears at the Q output of flip-flop 72 on the lead 74. This signal is applied to the D input of the D-type flip-flop 76, which also has the clock signal on the lead 36 applied to its clock input. Accordingly, the $\overline{Q}$ output of the flip-flop 76 on the lead 78 is the inverse of the signal on the lead 74, delayed by one full cycle of the AC power.

The Q output of the flip-flop 72 and the $\overline{Q}$ output of the flip-flop 76 are applied as inputs to the NAND gate 80 which results in a signal on the lead 82 which is normally high but goes low for the next full cycle of the AC power after the start of the close input signal. (Since the open input signal on the lead 28 is also applied as an input to the gate 68, the signal on the lead 82 also goes low for the next full cycle of the AC power after the start of the open input signal.) The lead 82 is connected as an input to the AND-NOT gate 64. It will be recalled that the other input to the gate 64, on the lead 66, is the inverse of the clock pulses during the time that the close input signal is present. Therefore, the inverted output of the gate 64 on the lead 84 is normally high and goes low for the positive polarity half cycle of the next succeeding cycle of the AC power after the start of the close input signal. The signal on the lead 84 is provided as an input to the OR-NOT gate 86 whose inverted output on the lead 38 is utilized to trigger the triac 44 (FIG. 1) into conduction. This results in a single half cycle of positive AC power being applied to the relay coil 12, for energization of the relay 10 and closing of the output switch 14.

As previously described, when an open input signal is received on the lead 28, a pulse corresponding to the next succeeding full cycle of AC power is generated on the lead 82. This pulse is applied as an input to the AND-NOT gate 88. The open input signal is also applied as an input to the AND-NOT gate 90, whose other input is the clock signal on the lead 36. The inverted output of the gate 90 on the lead 92 is thus a series of clock pulses during the time that the open input signal is present. When combined in the gate 88 with the single pulse on the lead 82, there results on the lead 94 a single positive going pulse corresponding to the negative half cycle of AC power which is in the first cycle of AC power after the start of the open input signal. This pulse is applied to the one-shot circuit 96 which is arranged to provide on its output lead 98 a single negative going pulse beginning at the leading edge of the input pulse on the lead 94 and terminating approximately 6.33 milliseconds thereafter. (The duration of the pulse on the lead 98 can be chosen to be any appropriate time less than a half cycle of the AC power.) The signals on the leads 94 and 98 are applied as inputs to the NAND gate 100 whose output on the lead 102 is a negative going pulse whose duration is the remainder of the negative half cycle of AC power not taken up by the output of the one-shot circuit 96. The pulse on the lead 102 is applied as an input to the OR-NOT gate 86, whose inverted output on the lead 38 is used to trigger the triac 44 for a portion of the negative half cycle of the AC power. In the illustrative embodiment, this results in the final 2 milliseconds of the negative cycle of AC power being applied to the coil 12, for deenergization of the relay 10 and opening of the output switch 14.

It has been found that under certain circumstances, a single pulse is insufficient to deenergize the relay. Therefore, it would be desirable to provide circuitry which continues applying the open pulses until the relay deenergizes. However, the effects of the deenergizing pulses are cumulative and the circuitry must insure that the continued pulses do not reenergize the relay by building up a magnetic field of the opposite polarity to the energizing field. It has been found that pulses having 2 milliseconds duration are short enough that this cumulative effect does not occur. The circuitry shown in FIG. 4 as a second embodiment for the control logic 20 operates to provide a series of 2 milliseconds deenergizing pulses in response to an open input signal until it is sensed that the output switch 14 has opened. An understanding of the operation of the circuit shown in FIG. 4 is best accomplished by referring to the timing chart shown in FIG. 5 which illustrates signals on different leads of the circuit shown in FIG. 4, and wherein the reference numerals applied to the signals shown in FIG. 5 correspond to the reference numerals of the corresponding leads in FIG. 4, but are primed.

Figure 4:
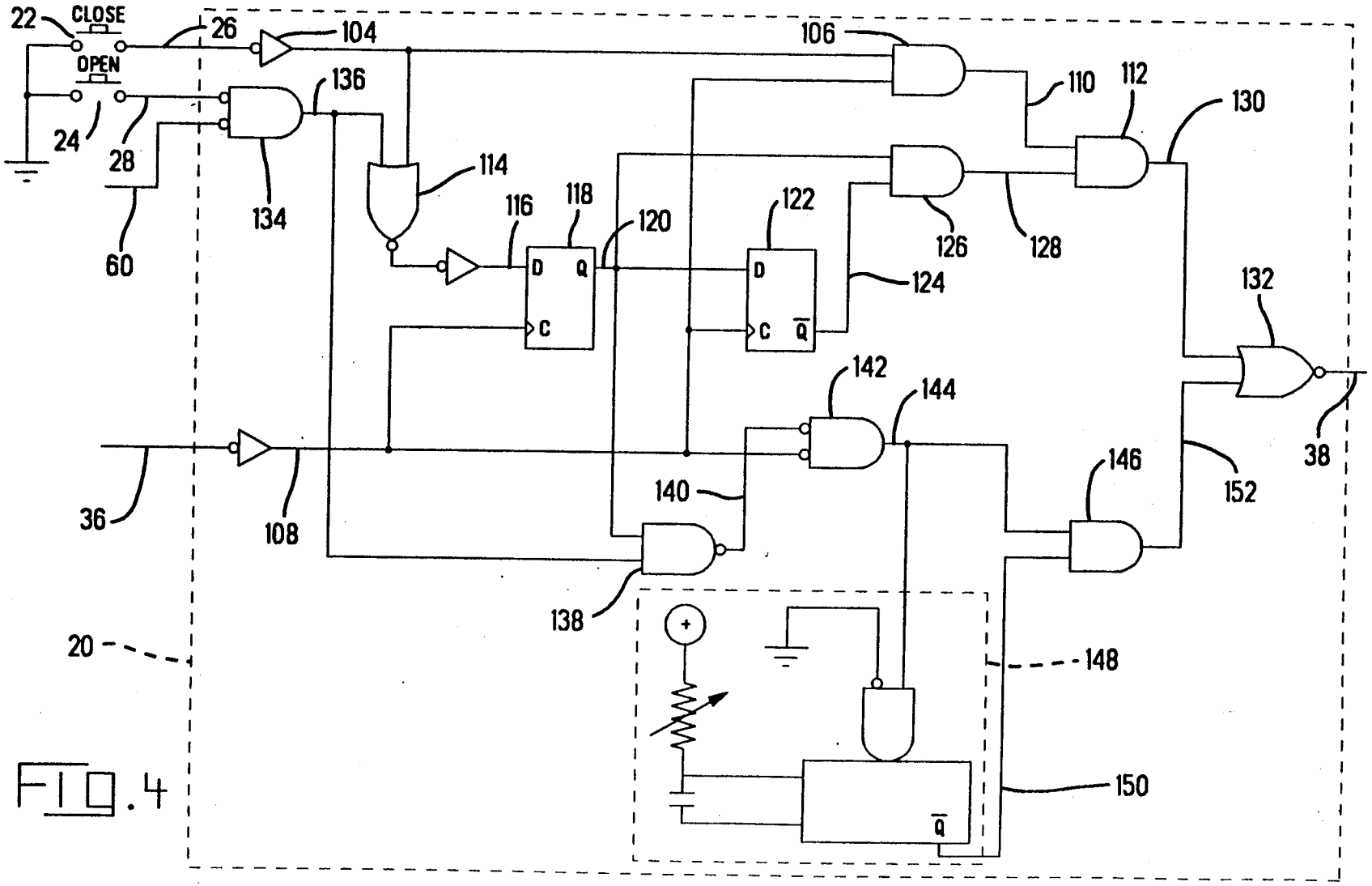
FIG. 4 is a schematic logic diagram of a second embodiment of control logic circuitry according to this invention for use in the system of FIG. 1.
Figure 5:
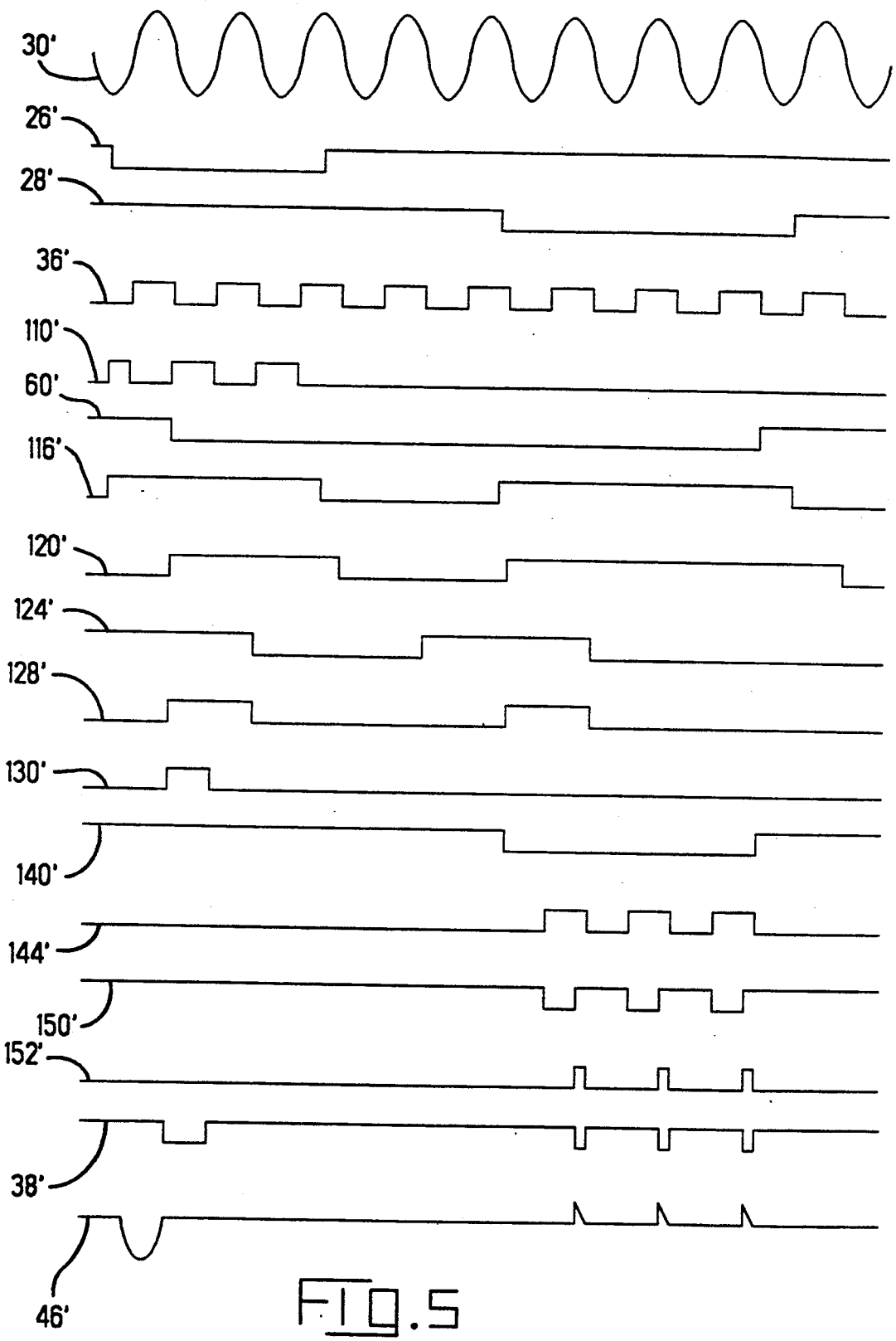
FIG. 5 is a timing chart useful in understanding the operation of the circuitry shown in FIG. 4.

Referring now to FIG. 4, it is initially assumed that the relay 10 is not energized and the output switch 14 is open. When it is desired to close the output switch 14, the close input switch 22 is momentarily closed, putting a low signal on the lead 26. This low signal is inverted by the inverter 104 and applied as an input to the AND gate 106. The other input to the AND gate 106 is the series of bilevel clock pulses on the lead 108, which have been inverted from the pulses on the lead 36, and correspond to the cycles of the input AC power. The output of the AND gate 106 on the lead 110 is applied as an input to the AND gate 112, and is the series of clock pulses from the lead 108 which occur during the duration of the close input signal on the lead 26. The inverted close input signal is also applied to the NOR gate 114, whose inverted output on the lead 116 is applied to the D input of the D-type flip-flop 118. The bilevel clock signal on the lead 108 is applied to the clock input of the D-type flip-flop 118. Accordingly, the Q output of the flip-flop 118 on the lead 120 is high for the next succeeding full cycles of the AC power after the start of the close input signal until the end of the first full cycle after the end of the close input signal. The Q output of the flip-flop 11B on the lead 120 is applied to the D input of the D-type flip-flop 122, which also has the clock signal on the lead 108 applied to its clock input. Accordingly, the $\overline{Q}$ output of the flip-flop 122 on the lead 124 is the inverse of the signal on the lead 120, delayed by one full cycle of the AC power.

The Q output of the flip-flop 118 and the $\overline{Q}$ output of the flip-flop 122 are applied as inputs to the AND gate 126, which results in a signal on the lead 128 which is normally low but goes high for the next full cycle of the AC power after the start of the close input signal. The signal on the lead 128 is applied as an input to the AND gate 112 which, it will be recalled, has its other input connected to the output of the AND gate 106 on the lead 110. Therefore, the output of the AND gate 112 on the lead 130 is a single positive going pulse during the negative polarity half cycle of the next succeeding cycle of the AC power after the start of the close input signal. The signal on the lead 130 is provided as an input to the NOR gate 132 whose output on the lead 38 is utilized to trigger the triac 44 (FIG. 1) into conduction. This results in a single half cycle of negative AC power being applied to the relay coil 12, for energization of the relay 10 and closing of the output switch 14.

In the embodiment shown in FIG. 4, a feedback signal is provided on the lead 60 to indicate the state of the output switch 14 (FIG. 1), as described above. The signal on the lead 60 gates the open input signal on the lead 28 through the AND-NOT gate 134. It will be recalled from the foregoing description of FIG. 1, that, whenever the output switch 14 is closed, there is a low signal on the lead 60. Accordingly, if the output switch 14 is closed and an open input signal is received on the lead 28, a high signal is gated through the gate 134 onto the lead 136 for the duration of the open input signal. This signal is applied as an input to the NOR gate 114 which results, as described above, in a pulse on the lead 120 which is a clock-synchronized version of the signal on the lead 136. The signals on the leads 120 and 136 are applied as inputs to the NAND gate 138, whose output on the lead 140 is normally high but is low for the duration of the signal on the lead 120 so long as there is an open input signal on the lead 28 and the output switch 14 is still closed. The signal on the lead 140 is applied as an input to the AND-NOT gate 142 whose other input is the clock signal on the lead 108. The output of the gate 142 on the lead 144 is applied as an input to the AND gate 146 as well as to the one-shot circuit 148. The one-shot circuit 148 is arranged to provide on its output lead 150 a single negative going pulse beginning at the leading edge of the input pulse on the lead 144 and terminating approximately 6.33 milliseconds thereafter. Since a series of input pulses are applied via the lead 144 (see FIG. 5), a series of pulses are provided on the lead 150. These pulses are provided as an input to the AND gate 146, along with the pulses on the lead 144, which results in a series of positive going pulses on the lead 152, each having a duration which is the remainder of the positive half cycle of AC power not taken up by the output of the one-shot circuit 148. The pulses on the lead 152 are applied as an input to the NOR gate 132, whose output on the lead 38 is used to trigger the triac 44 for successive portions of the positive half cycles of the AC power. This continues until the output switch 14 opens, at which time the signal on the lead 60 goes high, terminating the operation of the control logic 20 until a close input signal is subsequently received. In the embodiment illustrated herein, three pulses are required to deenergize the relay 10.

It is noted that in the embodiment shown in FIG. 2, the positive half cycles of the AC power are utilized to energize the relay and the negative half cycles of the AC power are utilized to deenergize the relay 10, whereas in the embodiment of FIG. 4, the opposite half cycles are utilized. The characteristics of the relay 10 are such that the particular polarity used for energizing or deenergizing the relay 10 is immaterial, so long as opposite polarities are so utilized.

Accordingly, there has been described an arrangement for driving a single coil magnetic latching relay from an AC source. While two illustrative embodiments have been disclosed, it will be apparent to one of ordinary skill in the art that various modifications and adaptations to the disclosed arrangements can be made without departing from the spirit and scope of the invention, which is only intended to be limited by the appended claims.

We claim:

1. An arrangement for controlling a single coil magnetic latching relay having an output switch that is closed and remains closed when the relay is energized by a pulse across its coil of a first polarity and is opened and remains open when the relay is deenergized by a pulse across its coil of a second polarity, comprising:

close input means for receiving a close signal indicating that said output switch is to be closed;

open input means for receiving an open signal indicating that said output switch is to be opened;

means for receiving AC power;

close means coupled to said close input means and responsive to a close signal received thereat for applying a half cycle pulse of said AC power having said first polarity to the coil of said relay; and open means coupled to said open input means and responsive to an open signal received thereat for applying a pulse which is a portion of a half cycle of said AC power having said second polarity to the coil of said relay, said portion being chosen so that the effective current at said second polarity is insufficient to reenergize said relay.

2. The arrangement according to claim 1 further including feedback means for providing a feedback signal indicative of the state of said output switch and wherein said open means is responsive to said feedback signal for providing said pulses of said second polarity of AC half cycle portions to the coil of said relay until said feedback signal indicates that said output switch is open.

3. An arrangement for controlling a single coil magnetic latching relay having an output switch that is closed and remains closed when the relay is energized by a pulse across its coil of a first polarity and is opened and remains open when the relay is deenergized by a pulse across its coil of a second polarity, comprising:

close input means for receiving a close signal indicating that said output switch is to be closed;

open input means for receiving an open signal indicating that said output switch is to be opened;

means for receiving AC power;

means for connecting AC power from said AC power receiving means across said coil;

switching means in series with said coil, said switching means being controllable for selectively closing a conductive path for said AC power through said coil;

close means coupled to said close input means and responsive to a close signal received thereat for controlling said switching means to provide said conductive path for a half cycle of the AC power at a first polarity; and open means coupled to said open input means and responsive to an open signal received thereat for controlling said switching means to provide said conductive path for a portion of a half cycle of a second polarity of the AC power, said portion being chosen so that the effective current at said second polarity is insufficient to reenergize said relay.

4. The arrangement according to claim 3 wherein said portion of a half cycle of the second polarity of the AC power has a duration of approximately 25 percent of the duration of the half cycle.

5. The arrangement a to claim 3 wherein said switching means includes a photosensitive triac.

6. The arrangement according to claim 3 wherein said switching means is optically coupled to said close means and said open means.

7. The arrangement according to claim 3 wherein said close means includes:

means responsive to said close signal for providing a single pulse corresponding in time to the next full half cycle of the first polarity of AC power after the start of said close signal; and means for utilizing said single pulse for controlling said switching means to close said conductive path to said coil for the duration of said single pulse.

8. The arrangement according to claim 3 wherein said open means includes:

means responsive to said open signal for providing a first pulse corresponding in time to a succeeding full half cycle of the second polarity of AC power;

means for providing a second pulse beginning a fixed time after the start of said first pulse and ending at the same time as the end of said first pulse; and means for utilizing said second pulse for controlling said switching means to close said conductive path to said coil for the duration of said second pulse.

9. The arrangement according to claim 8 further including feedback means for providing a feedback signal indicative of the state of said output switch and wherein said open means is responsive to said feedback signal for providing a series of said second pulses until said feedback signal indicates that said output switch is open.

10. The arrangement according to claim 8 wherein said fixed time after the start of said first pulse is approximately 75 percent of the duration of a half cycle of the AC power.

* * * * *